US005557259A

United States Patent [19]

Musa

[11] Patent Number: 5,557,259

[45] Date of Patent: Sep. 17, 1996

[54] PROXIMITY ALERT AND DIRECTION INDICATOR

[76] Inventor: John S. Musa, 2 Westervelt Ave., Clifton, N.J. 07011

[21] Appl. No.: 419,427

[22] Filed: Apr. 10, 1995

[51] Int. Cl.[6] ..... G08B 21/00

[52] U.S. Cl. ..... 340/573; 340/539; 455/100

[58] Field of Search ..... 340/573, 539; 455/100

[56] References Cited

U.S. PATENT DOCUMENTS

| | | | |
|---|---|---|---|
| 4,593,273 | 6/1986 | Narcisse | 340/539 |
| 4,785,291 | 11/1988 | Hawthorne | 340/573 |
| 5,115,223 | 5/1992 | Moody | 340/573 |
| 5,119,072 | 6/1992 | Hemingway | 340/573 |
| 5,274,359 | 12/1993 | Adams | 340/539 |
| 5,289,163 | 2/1994 | Perez et al. | 340/539 |

*Primary Examiner*—Glen Swann
*Attorney, Agent, or Firm*—Michael I. Kroll

[57] ABSTRACT

A proximity alert and direction indicator is provided that allows an observer to monitor the proximity of a subject under surveillance, particularly a child. The subject wears a transmitter removeably attached to the shoe. The observer wears a receiver-containing bracelet. The receiver contains a proximity detector with threshold set that emits an audible sound when the distance between the subject and the observer exceeds some preset distance. The receiver also contains a direction finder with graphic display that shows the observer the direction to the subject.

4 Claims, 2 Drawing Sheets

PROXIMITY ALERT AND DIRECTION INDICATOR

BACKGROUND OF THE INVENTION

The instant inventions relates, generally, to the field of direction finding transmitter and receiver, and, more specifically, to systems designed to track subjects under surveillance.

At the present time parents and other caretakers are particularly concerned that their charges may be in danger if the charge wanders beyond the audible or visual field of view of the caretaker. One solution that is frequently employed is to tether the charge to the caretaker by physical means such as a strap with buckles. However, this technique unnecessarily restricts the range of movement of the charge, the strap can tangle and even choke an individual.

A better technique is required that would allow a subject under surveillance considerable freedom of movement while sounding some alarm when the distance between the subject under surveillance and the observer exceeds some preset limit.

BACKGROUND OF THE PRIOR ART

A number of solutions have been suggested that address the need to provide the required surveillance. For instance, B. Narcisse (U.S. Pat. No. 4,593,273) proposes an out-of-range personnel monitor and alarm; however, it does not provide any direction indication or adequate means for attaching the transmitter to the subject under surveillance.

C. Hawthorne (U.S. Pat. No. 4,785,291) suggests a distance monitor especially for child surveillance that similarly it does not provide any direction indication or adequate means for attaching the transmitter to the subject under surveillance.

T. Moody (U.S. Pat. No. 5,115,223) provides a personnel location monitoring system and method that uses a receiver that is too unwieldy and bulky to be easily worn by an observer since the direction finding capability comprises a rotatable direction finding antenna.

M. Hemingway (U.S. Pat. No. 5,119,072) provides an apparatus for measuring child activity that does not provide an direction indication.

SUMMARY OF THE INVENTION

It is, therefore, a primary object of the present invention to provide a proximity alert and direction indicator that permits an observer equipped with a receiver to be alerted when a subject under surveillance wearing a transmitter travels beyond a preset threshold distance.

Another object is to provide a proximity alert and direction indicator wherein the transmitter is mounted to the shoe of the subject under surveillance.

A further object is to provide a proximity alert and direction indicator wherein the receiver is contained in a bracelet worn by the observer.

A yet further object is to provide a proximity alert and direction indicator in which the bracelet receiver has an audible alarm which sounds when the subject under surveillance moves beyond a preset distance.

Another object is to provide a proximity alert and direction indicator in which the bracelet receiver has a graphic display which indicates the direction between the observer and the subject under surveillance.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
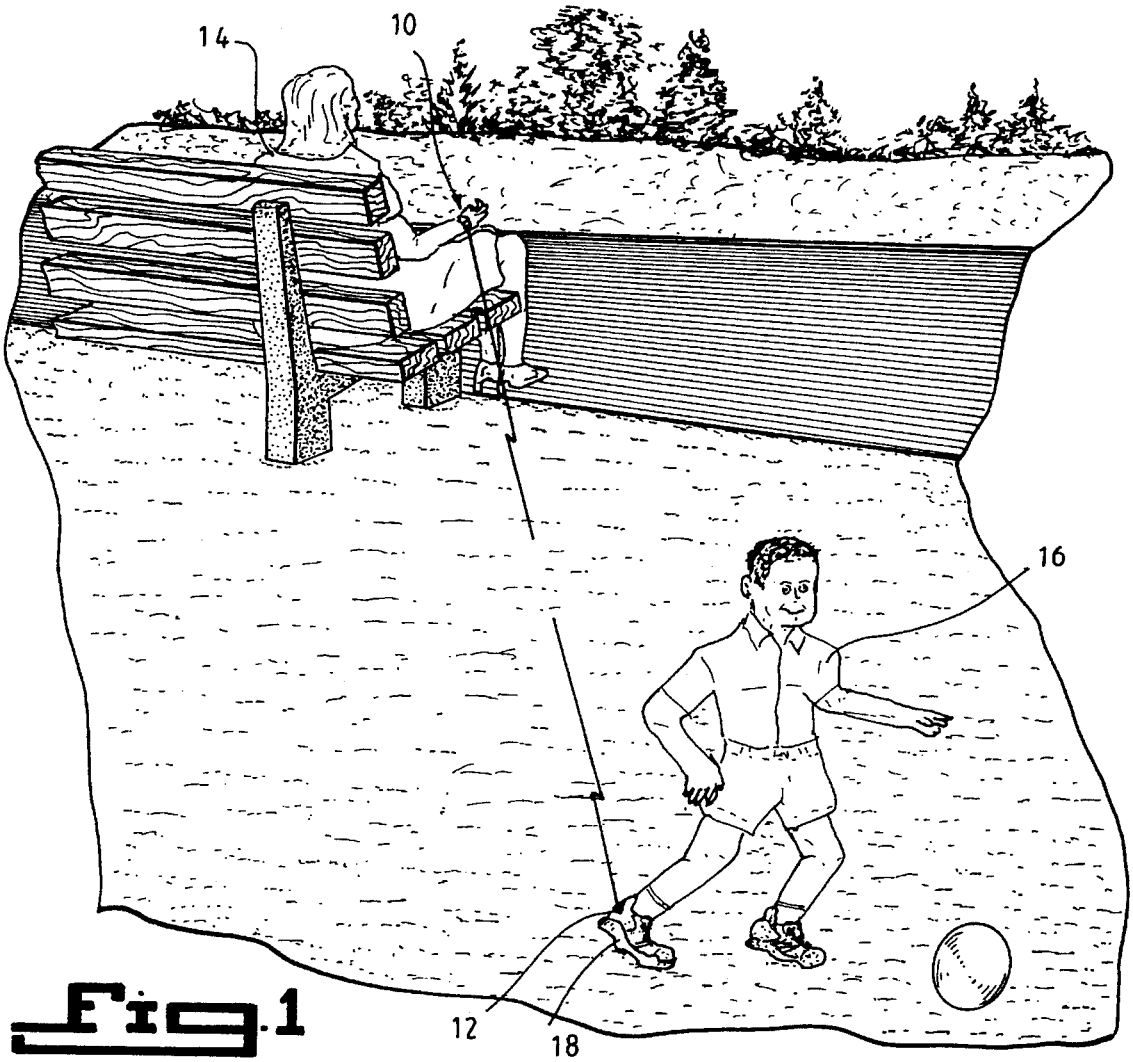
FIG. 1 is an illustration showing an observer wearing the bracelet receiver and a subject under surveillance wearing the transmitter attached to his shoe.

In FIG. 1, an observer 14 wishes to keep the subject under surveillance, child 16, within some preset distance. To effect this, the observer 14 wears bracelet receiver 10, while the subject under surveillance 16 wears transmitter 12 on shoe 18.

Figure 2:
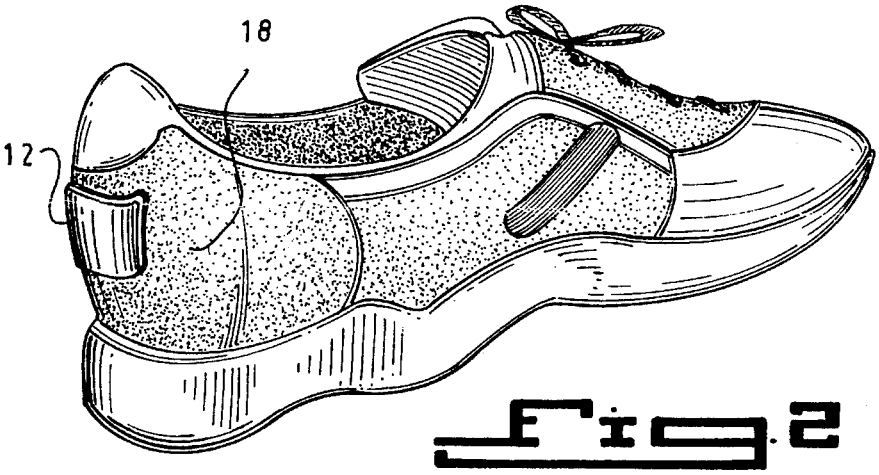
FIG. 2 is an illustration of the shoe showing the transmitter attached thereto.
Figure 3:
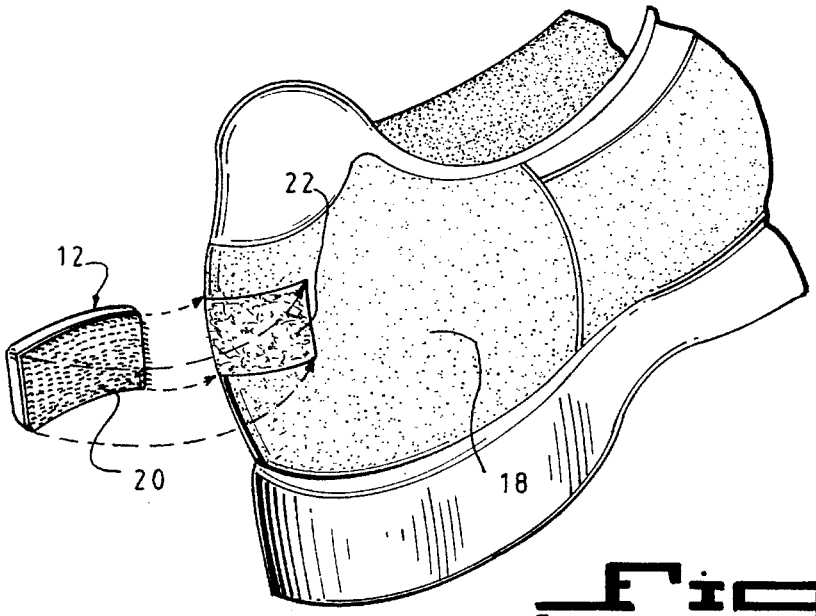
FIG. 3 is another illustration of the shoe showing the attachment means of the transmitter.

The attachment of the transmitter 12 to shoe 18 can best be understood with reference to FIGS. 2 and 3. A piece of hook and loop pile type fastener material 22 is attached above the heel of shoe 18. A mating piece of hook and loop pile type fastener material 20 is attached to the inner surface of transmitter 12. This allows the transmitter 12 to be removeably attached to shoe 18. Alternatively, transmitter 12 may be permanently attached to shoe 18.

Figure 4:
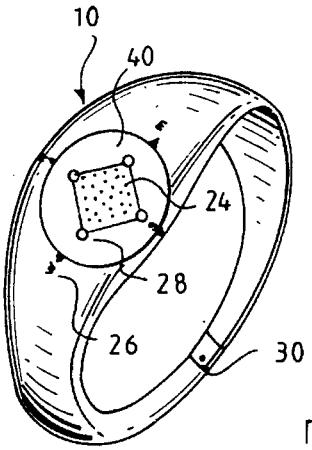
FIG. 4 is an illustration of the bracelet receiver showing the graphic display and latch system.
Figure 5:
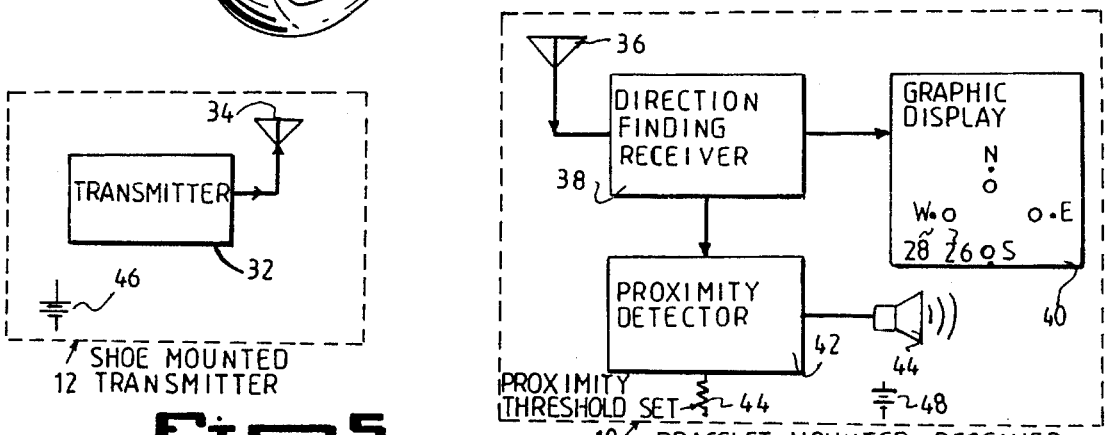
FIG. 5 is an electronic block diagram of the invention showing the shoe mounted transmitter and the bracelet mounted receiver.

The detailed operation of the invention can best be understood with reference to FIG. 4 and FIG. 5. The shoe mounted transmitter 12 contains transmitter 32, a conventional radio frequency transmitter with battery power source 46 and antenna 34. The bracelet receiver 10 contains a conventional direction finding receiver 38 that is connected to antenna 36 and battery 48. One output of receiver 38 is connected to proximity detector 42 whose threshold level is controlled by proximity threshold set potentiometer 44. When the signal from direction finding receiver 38 falls below the level determined by proximity threshold set potentiometer 44, proximity detector 42 emits a signal that causes audible transducer 44 to emit an audible sound. Transducer 44 may be an electromagnetic speaker or a piezoelectric speaker.

Another output of direction finding receiver 38 is connected to graphic display 40. This display shows the prime compass points, such as 28 (West) and an indicator is illuminated, such as indicator 26 (West), showing the direction between the observer and the subject under surveillance.

A clasp 30 allows bracelet transmitter 10 to be removeably worn.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A proximity alert and direction indicator comprising:

a. radio transmitter means worn on the shoe of a subject under surveillance, said transmitter means being attached by hook and pile type fastener material to permit said transmitter means to be removed and located on the back of the shoe adjacent the heel;

b. a bracelet worn on the wrist of an observer, said bracelet carrying direction finding radio receiver means to receive a radio signal issued by said transmitter means;

c. proximity detector means connected to said receiver means to output an alarm signal when the distance between said transmitter means and said receiver means exceeds some preset value, and including means for adjusting said preset value; and d. transducer means connected to said proximity detector including speaker means to issue an audible alarm to said observer when said alarm signal is received.

2. A proximity alert and direction indicator, as recited in claim 1, wherein said speaker means is an electromechanical magnetic speaker.

3. A proximity alert and direction indicator, as recited in claim 1, wherein said speaker means is a piezoelectric speaker.

4. A proximity alert and direction indicator, as recited in claim 1, wherein said transducer means comprises a graphic display that provides a visible indication to said observer that the distance between said observer and said subject under surveillance has exceeded some preset threshold.

* * * * *